US005569126A

United States Patent [19]

Perussi et al.

[11] Patent Number: 5,569,126

[45] Date of Patent: Oct. 29, 1996

[54] ENERGY ABSORBING EXERCISER APPARATUS

[76] Inventors: Roberto A. Perussi; Ruben O. Perussi, both of 10 Thomas, Irvine, Calif. 92718

[21] Appl. No.: 612,663

[22] Filed: Mar. 8, 1996

[51] Int. Cl.[6] ..... A63B 69/16; A63B 22/04

[52] U.S. Cl. ..... 482/51; 482/62

[58] Field of Search ..... 482/51, 52, 53, 482/57, 62, 148, 63, 900

[56] References Cited

U.S. PATENT DOCUMENTS

| | | | |
|---|---|---|---|
| 326,247 | 9/1885 | Root | 482/62 |
| 4,842,269 | 6/1989 | Huang | 482/62 |
| 4,936,573 | 6/1990 | Miller | 272/131 |
| 5,044,627 | 9/1991 | Huang | 482/62 |
| 5,050,864 | 9/1991 | Pertramer | 482/62 |
| 5,114,391 | 5/1992 | Pitzen et al. | 482/62 |
| 5,370,594 | 12/1994 | Grinblat | 482/72 |
| 5,383,829 | 1/1995 | Miller | 482/51 |
| 5,401,226 | 3/1995 | Stearns | 482/51 |
| 5,423,729 | 6/1995 | Eschenbach | 482/51 |

*Primary Examiner*—Stephen R. Crow
*Attorney, Agent, or Firm*—Gene Scott Patent Law & Venture Group

[57] ABSTRACT

An exercise device absorbs work during both to, as well as fro, motion of an exercise handle. In both cases, the work is imparted to a flywheel which drives a braking mechanism capable of resisting the work at any predetermined selected level over a range of choice. A pair of drive racks each provide a linear gear coupled with a pair of pinion gears integral with rotational clutches on a drive shaft. A first of the clutches is configured to engage with the drive shaft when it is driven to rotate in one direction of rotation, while freewheeling in the opposite direction, while the other of the clutches is configured in reverse to the first. As the racks move in a first linear direction, one of the pinion gears drives the shaft, and the flywheel to which it is attached, while the other of a the pinion gears freewheels. When the racks move in the opposite direction, the roles of the pinion gears are reversed. In this way, the racks are always driving the flywheel in the same direction of rotation and the movement of the exercise handle is always braked as desired. The present invention is an exercise apparatus having an energy absorbing means. Each action incorporates a mechanical movement converting physical output of the user to rotational motion and thereby powering an electrical generator, preferably in the form of a alternator. An exercise controller selects loads to be applied to the alternator. The loads are coupled by the mechanical movements back to the user to provide resistance to the exercise effort.

7 Claims, 4 Drawing Sheets

ENERGY ABSORBING EXERCISER APPARATUS

BACKGROUND OF THE INVENTION

1. Field of the Invention

This invention relates generally to exercise devices, and more particularly to an improved exercise apparatus capable of absorbing energy imparted to it in a reciprocating manner so that exercise resistance is provided on both strokes of the reciprocating movement.

2. Description of Related Art

Invention and use of exercise apparatus is known to the public, as they are frequently used by body builders and anyone interested in improving strength and flexibility. Pitzen et al. U.S. Pat. No. 5,114,391 discloses an exercise device providing mechanical actions for independent or simultaneous exercise of the upper and lower body of a human user. Each action incorporates a mechanical movement converting output of the user to rotational motion and thereby powering one of two electrical generators. An exercise controller selects loads to be applied to the generators. The loads are coupled by the mechanical movements back to the user to provide resistance to the exercise effort. The exercise controller drives an electronic display which informs the user of his or her intensity of effort as well as the proportion of that effort being met through exercise of the lower body. Moore et al. U.S. Pat. No. 5,110,122 discloses an exercising apparatus which is adapted for home use and is versatile to permit the performing of a large number of exercises with a single piece of equipment and which incorporates the exercise facilities offered by several conventional pieces of exercising equipment. The exercising apparatus comprises a seat section at one end with a back rest capable of being raised from a frame for supporting the lower back during various types of exercises including abdominal exercises. The seat back can be lowered in order to enable an individual to lay in a prone condition on the exercising apparatus in order to perform additional exercises such as abdominal exercises and the like. A method of exercising is also disclosed. Grinblat U.S. Pat. No. 5,370,594 discloses an adjustable and configurable exercise machine having a base sitting on the floor to which is pivotally attached an adjustable seat mechanism. Attached to the seat mechanism at a point located between the pivotally attached end and the seat is an arm actuated handle. Near the pivot is an adjustable pivot point to which is attached an adjustable control link. The purpose of the adjustable pivot point is to change the leverage ratio and the purpose of the adjustable control link is to change the position of the handle relative to the user. The second end of the adjustable control link is attached to a vertical upright member of the base frame assembly. A counter force capability is provided to counter the weight of the user. The user in a first use sits on the seat astride the machine with the feet on the foot rests and pulls with the arms and pushes with the feet. In a second use the pivot pin attaching the adjustable control link to the seat mechanism is removed and the handle is rotated against the seat. The user stands at the rear facing forward with the hands upon the transverse handle bar and pushes the handle downward against the counterforce thus promoting exercise. In a third exercise the user sits on the floor behind the machine with the handle bar also collapsed against the seat. The feet are placed against the seat. The feet are placed against the rear of the foot rests with the heels on the floor and the hands grasp the transverse handle and pull the bar downward. Miller U.S. Pat. No. 4,936,573 discloses an exercise machine for elderly or handicapped people includes left and right exercise mechanisms which are substantially identical. Each exercise mechanism includes an adjustable handle assembly which is connected to an adjustable friction mechanism. Each exercise mechanism also includes a pivotally mounted foot pad which is connected by a linkage mechanism to the respective handle assembly. During use, the person sits on a support such as a chair or bed with the exercise machine in front of him. With his feet resting on the pivotally mounting foot pads, the person pushes and pulls the handle assemblies, either alternately or in unison. This stroking motion causes the foot pads to pivot up and down, thereby stimulating the person's feet and legs by flexing the joints and stretching the muscles. Reynolds U.S. Pat. No. 5,176,601 discloses an exercising apparatus which is provided permitting the concurrent isometric stressing of the leg muscles while performing a plurality of arm stressing exercise, or alternatively, permitting an isometric stress to be maintained in the arm muscles in a selected direction while exercising the leg muscles. All of the exercising stresses are produced by compressing springs in tubular housings being positioned in a plurality of angular positions relative to the frame structure.

The prior art does not teach a means for providing easily selectable resistance in a reciprocating mechanism so that resistance on both strokes is enabled. The present invention fulfills this need and provides further related advantages as described in the following summary.

SUMMARY OF THE INVENTION

The present invention is an exercise apparatus having an energy absorbing means. Each action incorporates a mechanical movement converting physical output of the user to rotational motion and thereby powering an electrical generator, preferably in the form of a alternator. An exercise controller selects loads to be applied to the alternator. The loads are coupled by the mechanical movements back to the user to provide resistance to the exercise effort. The exercise controller drives an electronic display which informs the user of his or her intensity of effort as well as the proportion of that effort being met through exercise. Uniquely, the apparatus provides for directing the work of exercise to a flywheel on both forward and backward exercise strokes. This is accomplished by mounting a pair of pinion gears on the drive axle of a flywheel. The pinion gears are integral with rotational clutches. The clutches act like ratchets wherein a pawl locks the pinion gear to the drive axle in one rotational direction, while slipping in the other rotational direction of the clutch. Since the racks are mounted to the same drive arm, they move together in unison, driven by the exercise machine. As the forward stroke starts, one of the racks, drives one of the pinion gears to move the flywheel in its preferred rotational direction. The other of the racks, spins the other of the pinion gears in the opposite direction; this gear freewheeling on the drive axle. In the reverse movement of the drive arm, the roles of the pinion gears and their clutches are reversed, so that drive action occurs in both directions of the drive arm.

Thus, it is a first object of the present invention to provide an improved apparatus of the type described. It is a second object of the invention to provide a selectable resistance to exercise motion during both a forward and a rearward direction, so that gainful exercise is obtained during a full reciprocating cycle. It is a further object of the invention to provide a simplified mechanical mechanism so that simplicity, mechanical robustness, economy and low maintenance is required.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, an exercise device. In such drawings.

DETAILED DESCRIPTION OF THE PREFERRED EMBODIMENT

Figure 1:
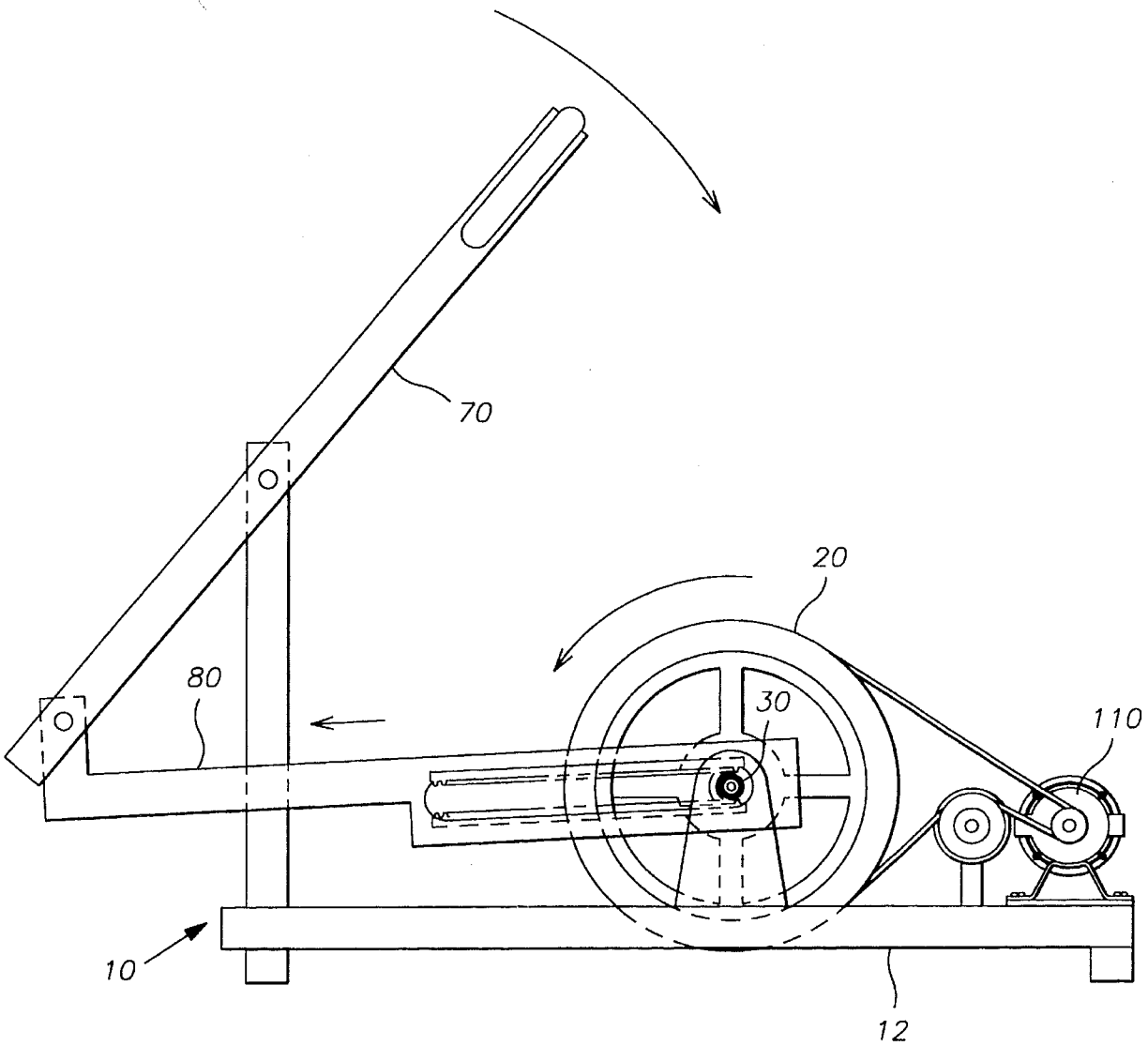
FIG. 1 is a side elevational view of the preferred embodiment of the present invention showing the exercise handle in a rearward position.
Figure 2:
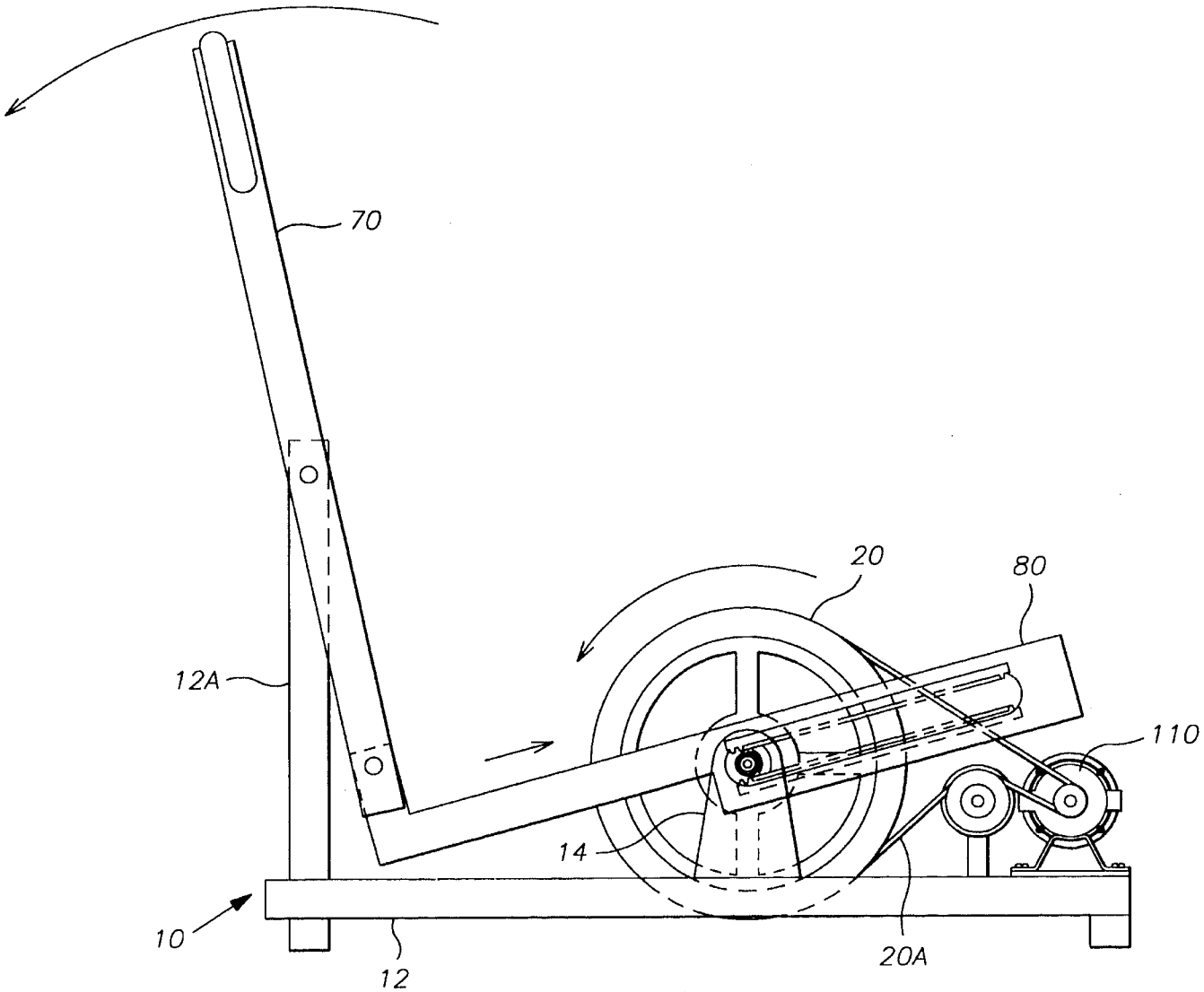
FIG. 2 is a side elevational view of the preferred embodiment of the present invention showing the exercise handle in a forward position.

The above described drawing figures illustrate an apparatus for exercising. The apparatus provides a means for supporting 10 a rotating fly wheel 20 which is mounted on a flywheel shaft 30. The supporting means 10 is preferably a horizontally oriented base 12 providing a pair of spaced apart, upwardly extending support arms 14. This supporting means 10 is preferably constructed so as to provide a stable platform for mounting an exercise structure such as a seat, foot rests or foot levers, hand grips, means for resistance to exercise and so on. The shaft 30 has a rotational axis 32, which, in the preferred mode, is oriented horizontally. The shaft 30 supports a pair of rotational clutches 50A, 50B in rotational engagement on the shaft 30. One of the clutches 50A is mounted so as to freewheel in a first rotational sense 60A of the shaft 30, and to engage for driving the shaft 30 in a second rotational sense 60B. The other of the clutches 50B is mounted so as to freewheel in the second rotational sense 60B of the shaft, and to engage for driving the shaft 30 in the first rotational sense 60A. The first and second rotational senses 60A, 60B are opposites.

Figure 4:
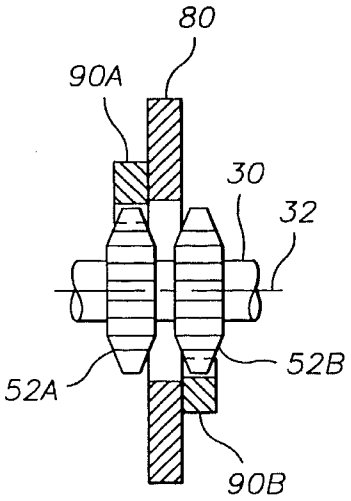
FIG. 4 is a cross-sectional view thereof taken along line 4—4 of FIG. 3, particularly showing the engagement of the pinion gears and the drive racks.
Figure 3:
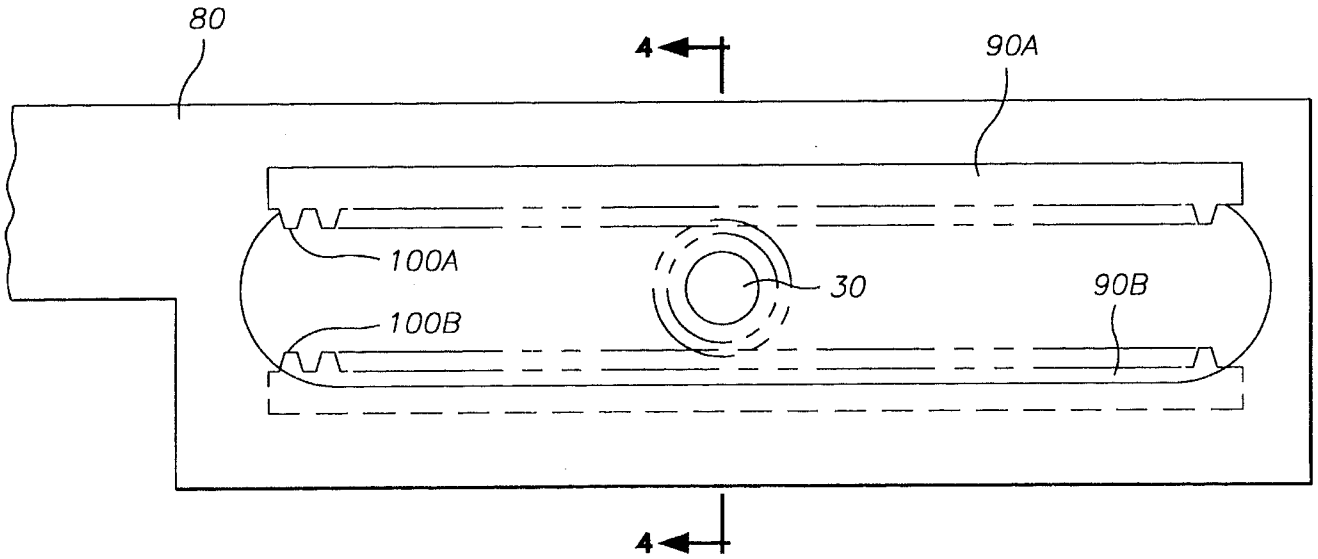
FIG. 3 is a side elevational view of a drive arm and drive racks of the invention showing their relationship to a flywheel shaft, clutches and pinion gears.
Figure 5:
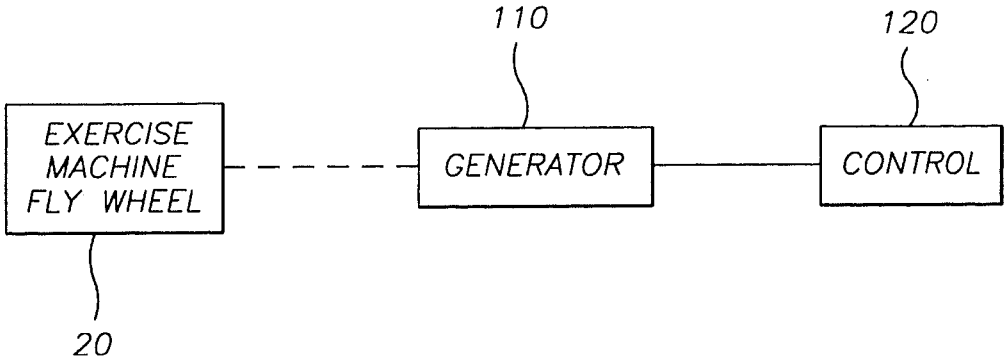
FIG. 5 is a block diagram showing the relationship between the exercise machine, an alternator, or load, and a control device for controlling the load.
Figure 6:
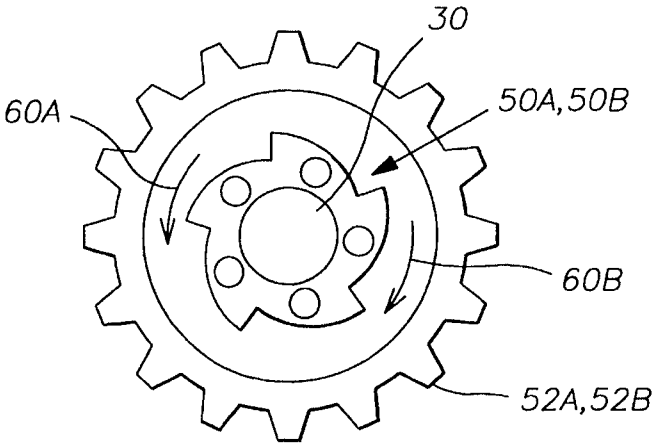
FIG. 6 is a schematic of the clutch and pinion gear assembly of the invention.

An upright exercise arm 70 is pivotally engaged with an upright portion 12A of the supporting means 10. The exercise arm 70 is therefore restrained to move in an arc, preferably to-and-fro in performing an exercise. A drive arm 80 is pivotally engaged with the exercise arm 70 so that as the exercise arm 70 moves, it also moves the drive arm 80 back and forth over a linear path. The drive arm 80 mounts a pair of drive racks 90A, 90B. Each of the racks 90A, 90B provides a set of linearly arranged drive teeth 100A, 100B. The drive racks 90A, 90B are spaced apart in parallel relationship on the drive arm 80, as shown in FIGS. 3 and 4, preferably, one above the other, and are mounted laterally offset to each other, preferably one on each side of the drive arm 80. The drive teeth 100A, 100B are positioned to engage one of a pair of pinion gears 52A, 52B. Each of the pinion gears 52A, 52B is fixedly engaged with one of the clutches 50A, 50B respectively, the clutches being mounted side by side on the flywheel shaft 30. Thus, as the racks 90A, 90B move back and forth against the pinion gears 52A, 52B, driven by the exercise arm 70, the clutches 50A, 50B are rotated, thus driving the fly wheel shaft 30 in continuous rotational motion.

Arcuate motion of the exercise arm 70 continuously drives the flywheel shaft 30 through the drive arm 80, drive racks 90A, 90B and clutches 50A, 50B in alternate reciprocating power strokes as the arm 70 moves back and forth.

Additionally a means for variable rotation resistance 110 is preferably rotationally coupled, as by a flexible belt 20A to the flywheel 20 for rotational interaction with it, especially for braking the flywheel 20. The resistance means 110 is preferably an electrical generator, or motor driven as a generator, and preferably includes an adjustment means 120 such as a solid state control device capable of providing electrical resistance in the generator circuit. Therefore, the adjustment means 120 is able to set the level of difficulty of the exercise apparatus from moment to moment or in accordance with a preselected program, as is usual in such exercise apparatus. The work of exercise is directed to the flywheel 20 and thus to the generator 110. Electrical energy from the generator 110 is directed to flow through the adjustment means wherein it is converted into heat. This heat energy is conducted to, and dissipated by a heat sink (not shown).

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An exercise apparatus comprising: a flywheel a means for supporting a flywheel mounted on a flywheel shaft, the shaft having a rotational axis, the shaft further supporting a pair of rotational clutches integral with pinion gears in rotational engagement on the shaft, one of the clutches mounted so as to be freewheeling in a first rotational sense on the shaft and to be engaged for driving the shaft in a second rotational sense, the other of the clutches mounted so as to be freewheeling in the second rotational sense on the shaft, and to be engaged for driving the shaft in the first rotational sense, said first rotational sense being opposite to said second rotational sense;

an upright exercise arm pivotally engaged at a lower end thereof on the supporting means, the exercise arm thereby restrained to move in an arc;

a drive arm pivotally engaged with the exercise arm;

a pair of drive racks, each of the racks providing a set of linearly arranged drive teeth, the drive racks mounted on the drive arm, spaced apart in parallel relationship, each one of the sets of drive teeth engaging one of the pinion gears of one of the pair of clutches respectively; wherein arcuate motion of the exercise arm continuously driving the flywheel shaft through the drive arm, drive racks and clutches in alternate reciprocating power strokes.

2. The apparatus of claim 1 wherein the supporting means is a horizontally oriented base providing a pair of spaced apart, upwardly extending support arms.

3. The apparatus of claim 2 further including a means for variable rotation resistance, said resistance means rotationally coupled to the flywheel for rotation interaction therewith and for braking said flywheel.

4. The apparatus of claim 3 further including a means for adjustment of the resistance means.

5. The apparatus of claim 3 wherein the resistance means is an electrical alternator.

6. The apparatus of claim 1 wherein the drive racks are mutually laterally offset.

7. The apparatus of claim 1 wherein the clutches are positioned in side by side relationship on the drive shaft.

* * * * *